US011839792B2

(12) United States Patent
Zhu

(10) Patent No.: US 11,839,792 B2
(45) Date of Patent: Dec. 12, 2023

(54) MULTIFUNCTIONAL FITNESS CHAIR

(71) Applicant: Zhejiang Raytheon Technology Co., Ltd., Zhejiang (CN)

(72) Inventor: Xiangjun Zhu, Zhejiang (CN)

(73) Assignee: ZHEJIANG RAYTHEON TECHNOLOGY CO., LTD., Zhejiang (CN)

( * ) Notice: Subject to any disclaimer, the term of this patent is extended or adjusted under 35 U.S.C. 154(b) by 224 days.

(21) Appl. No.: 17/424,800

(22) PCT Filed: Jun. 14, 2019

(86) PCT No.: PCT/CN2019/091248
§ 371 (c)(1),
(2) Date: Jul. 21, 2021

(87) PCT Pub. No.: WO2020/151168
PCT Pub. Date: Jul. 30, 2020

(65) Prior Publication Data

US 2022/0088436 A1 Mar. 24, 2022

(30) Foreign Application Priority Data

Jan. 24, 2019 (CN) ..... 201920122341.4

(51) Int. Cl.
*A63B 23/02* (2006.01)
*A63B 21/04* (2006.01)
*A63B 21/055* (2006.01)

(52) U.S. Cl.
CPC ..... *A63B 23/0205* (2013.01); *A63B 21/0442* (2013.01); *A63B 21/0552* (2013.01)

(58) Field of Classification Search
CPC ..... A63B 23/0205; A63B 21/0442; A63B 21/0552; A63B 21/4029; A63B 21/4035;
(Continued)

(56) References Cited

U.S. PATENT DOCUMENTS 5,573,485 A * 11/1996 Geschwender .... A63B 23/0233 482/130
5,599,261 A 2/1997 Easley
(Continued)

FOREIGN PATENT DOCUMENTS

CN 202620593 U 12/2012
CN 202654611 U 1/2013
(Continued)

*Primary Examiner* — Andrew S Lo
(74) *Attorney, Agent, or Firm* — MUNCY, GEISSLER, OLDS & LOWE, P.C.

(57) ABSTRACT

A multifunctional fitness chair includes an underframe, an armrest frame, an upper backrest frame, and a lower backrest frame. The underframe comprises left and right underframes, and underframe fixed shaft, and the armrest frame comprises left and right armrest frames and armrest fixed shaft, the left and right underframes are hinged on the left and right armrest frames, and the extension parts of the left and right armrest frames are correspondingly provided with left and right limiting plates which restrict the upward rotation of the left and right underframes. The upper backrest frame is fixed with an upper backrest shaft bushing, and at least two sets of symmetrically distributed upper backrests are arranged on the upper backrest frame. The lower backrest frame is fixed with a lower backrest shaft bushing, and at least two sets of symmetrically distributed lower backrests are arranged on the lower backrest frame.

4 Claims, 3 Drawing Sheets

(58) Field of Classification Search
CPC ..... A63B 23/1236; A63B 2208/0247; A63B 21/4033; A63B 23/0211; A63B 21/4039; A63B 21/4047; A63B 23/03541; A63B 2208/0233; A63B 2210/50; A61H 2203/0431; A61H 15/00; A61H 2015/0014; A61H 2201/0161; A61H 2205/081
See application file for complete search history.

(56) References Cited

U.S. PATENT DOCUMENTS 5,759,137 A * 6/1998 Huang ..... A63B 23/0405 482/142
5,833,590 A * 11/1998 Chiu ..... A63B 23/0211 482/133
7,381,171 B2 * 6/2008 Chen ..... A63B 21/045 482/142
D647,153 S * 10/2011 Mishan ..... D21/687
8,911,336 B2 * 12/2014 Chiu ..... A63B 21/00069 482/130
D723,638 S * 3/2015 Zhu ..... D21/690
9,662,536 B1 * 5/2017 Lin ..... A63B 21/4033
D814,577 S * 4/2018 Lalaoua ..... A63B 23/0233 D21/688
2005/0015031 A1 * 1/2005 Lin ..... A61H 15/00 601/115
2005/0124922 A1 * 6/2005 Lin ..... A47C 7/14 601/126
2007/0232969 A1 * 10/2007 Yu ..... A61H 15/00 601/99
2010/0323861 A1 * 12/2010 Karwan ..... A47C 7/54 482/145
2011/0034839 A1 * 2/2011 Yang ..... A61H 15/00 601/128
2017/0296867 A1 * 10/2017 Doane ..... A61H 7/002

FOREIGN PATENT DOCUMENTS

CN 202666296 U 1/2013
CN 203507427 U 4/2014
DE 202005005437 U1 7/2005

* cited by examiner

MULTIFUNCTIONAL FITNESS CHAIR

TECHNICAL FIELD

The present invention relates to the technical field of sports fitness equipment, in particular to a multifunctional fitness chair capable of carrying out different fitness training.

BACKGROUND

With the progress of society and the development of science and technology, the living and working conditions of residents are getting better and better, the labor intensity is getting smaller and smaller, the social entertainment is getting more and more, and the mode of travel is gradually replaced by modern means of transportation. There is little time to participate in fitness exercises, and the physical quality continues to decline, which directly affects the work energy and efficiency.

In order to improve physical fitness and facilitate fitness training, a variety of fitness equipment came into being, especially the fitness chair which is suitable for family and office fitness, occupying a small space and convenient for storage is favored by the majority of consumers. However, the existing fitness chairs have the following problems in the process of use: one is that the function is single, and it can only do fitness training for the waist, and the fitness effect is not ideal; the other is that to match the fitness training of different exercises, it needs to be equipped with different sports fitness equipment, which not only has high purchase cost, but also has the problems of occupying large space and inconvenient storage. For this reason, many manufacturers and insightful people have carried out research and development, but so far no ideal products have been available.

SUMMARY

In order to overcome the above problems existing in the prior art, the object of the present invention is to provide a multifunctional fitness chair with simple and reasonable structure, convenient operation, multiple training functions, good fitness effect and small folding storage volume.

The technical scheme adopted by the present invention to solve the above technical problems comprises an underframe, an armrest frame, an upper backrest frame, and a lower backrest frame, wherein the underframe comprises left and right underframes, and underframe fixed shaft fixedly connected between the left and right underframes, and the armrest frame comprises left and right armrest frames and armrest fixed shaft fixedly connected between the left and right armrest frames, the left and right underframes are hinged on the left and right armrest frames through axle pins, and the extension parts of the left and right armrest frames are correspondingly provided with left and right limiting plates which restrict the upward rotation of the left and right underframes; the upper backrest frame is fixed with an upper backrest shaft bushing which can rotate relative to an underframe fixed shaft, the upper backrest frame is rotatably arranged on the left and right underframes through the upper backrest shaft bushing cooperating with the underframe fixed shaft, and at least two sets of symmetrically distributed upper backrests are arranged on the upper backrest frame; the lower backrest frame is fixed with a lower backrest shaft bushing which can rotate relative to an armrest frame fixed shaft, the lower backrest frame is rotatably arranged on the left and right armrest frames through the lower backrest shaft bushing cooperating with the armrest frame fixed shaft, and at least two sets of symmetrically distributed lower backrests are arranged on the lower backrest frame.

In the further scheme of the present invention, the left and right armrest frames are correspondingly arranged on the outside of the left and right underframes, and the extension parts of the left and right armrest frames are correspondingly fixed with the left and right armrests.

In the further scheme of the present invention, two sides of the left and right underframes are correspondingly provided with detachable elastic pull ropes.

In the further scheme of the present invention, the corresponding bushing of the underframe fixed shaft is arranged on the connecting pipes of the left and right underframes, and are fixedly connected by fasteners.

In the further scheme of the present invention, the corresponding bushing of the armrest fixed shaft is arranged on the connecting pipes of the left and right armrest frames, and are fixedly connected by fasteners.

Compared with the prior art, the structure has the following advantages and effects: first, it integrates fitness functions such as waist stiffening, deep V-shaped abdomen, sit-up, push-up, butt lift, abdomen lift, and back massage, etc., and is matched with elastic pull ropes on both sides of the left and right underframes, which can train arm strength and realize rowing function, so as to solve the problem of single function. Second, it has the advantages of simple structure, low purchase cost, multiple training functions, good fitness effect, small space occupation, convenient folding and storage, which is acceptable to ordinary consumers and easy to popularize.

Figure 1:
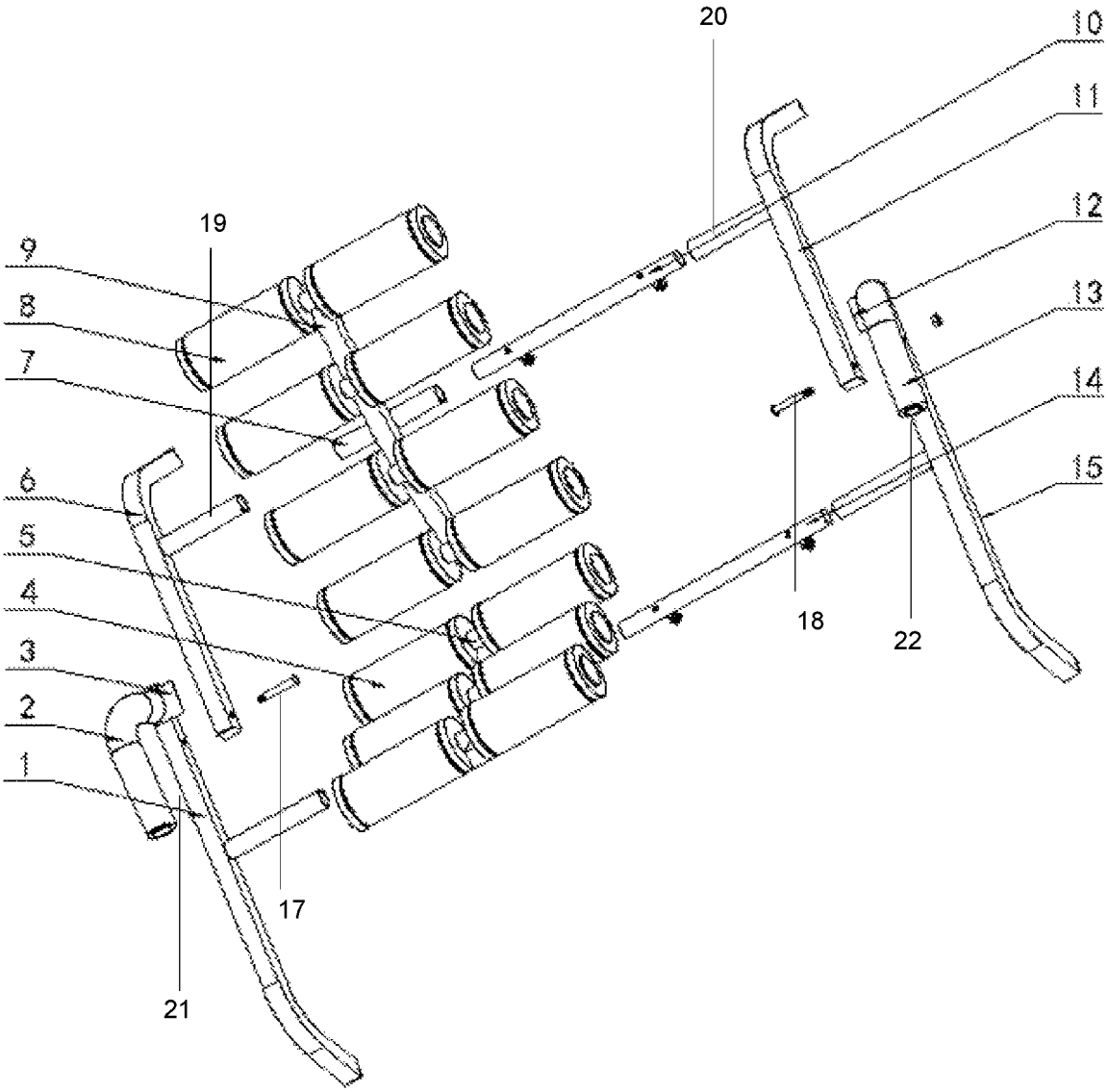
FIG. 1 is a schematic diagram of the decomposition structure of the present invention.
Figure 2:
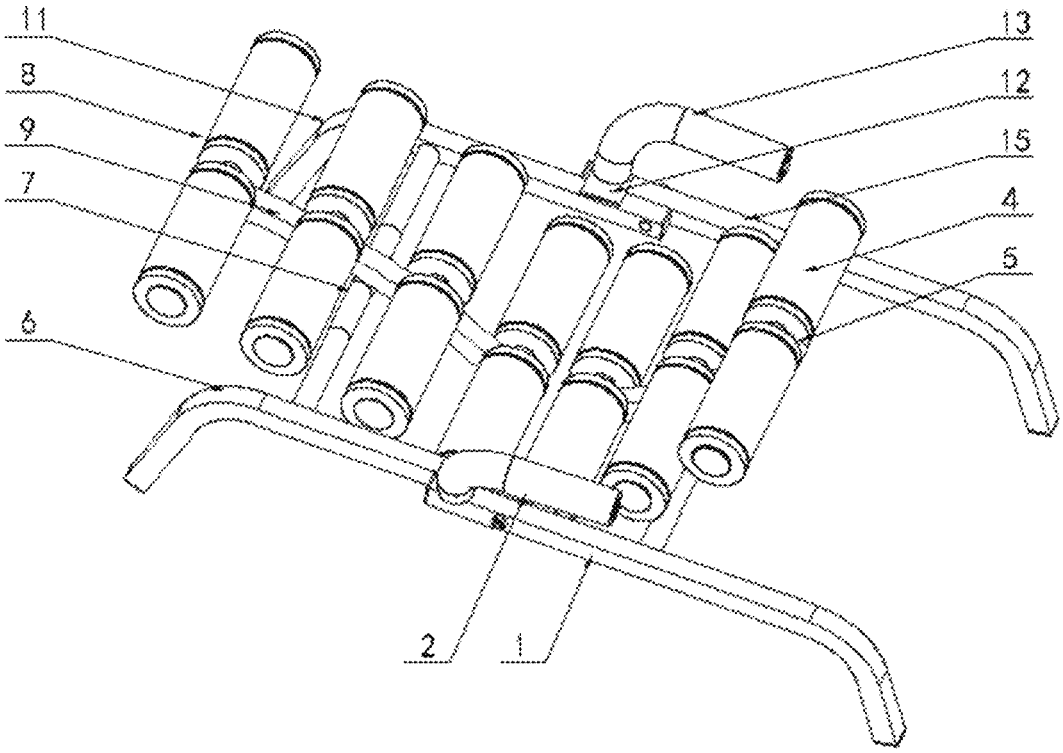
FIG. 2 is a schematic diagram of the three-dimensional structure of the present invention.
Figure 3:
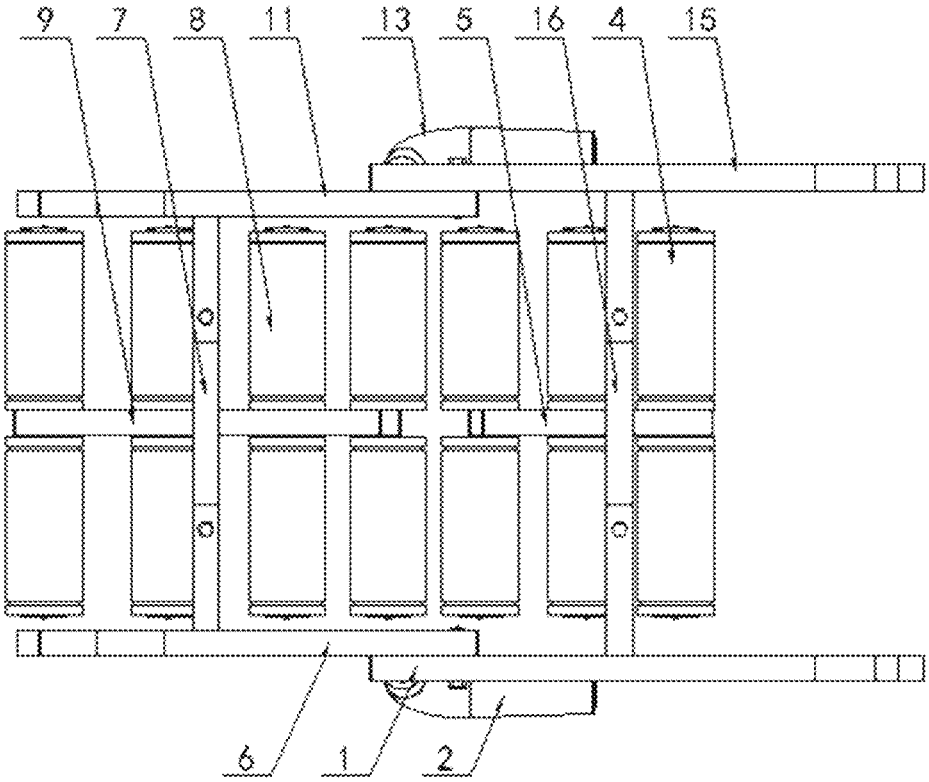
FIG. 3 is a schematic diagram of the bottom view structure of the present invention.

Wherein, 1 left armrest frame, 2 left armrest, 3 left limiting plate, 4 lower backrest, 5 lower backrest frame, 6 left underframe, 7 upper backrest shaft bushing, 8 upper backrest, 9 upper backrest frame, 10 underframe fixed shaft, 11 right underframe, 12 right limiting plate, 13 right armrest, 14 armrest frame fixed shaft, 15 right armrest frame, 16 lower backrest shaft bushing, 17 left axle pin, 18 right axle pin, 19 left extension part, 20 right extension part, 21 left connecting pipe and 22 right connecting pipe.

DETAILED DESCRIPTION

FIG. 1 to FIG. 6 show the specific implementation scheme of the multifunctional fitness chair of the present invention, which comprises an underframe, armrest frames, an upper backrest frame 9, and a lower backrest frame 5. The underframe comprises left and right underframes 6 and 11, and an underframe fixed shaft 10 fixedly connected between the left and right underframes 6 and 11, and the armrest frame comprises left and right armrest frames 1 and 15, and an armrest frame fixed shaft 14 fixedly connected between the left and right armrest frames 1 and 15. The left and right underframes 6 and 11 are hinged on the left and right armrest frames 1 and 15 through axle pins 17 and 18, and the extension parts 19, 20 of the left and right armrest frames 1 and 15 are correspondingly provided with left and right limiting plates 3 and 12 which restrict the upward rotation of the left and right underframes 6 and 11; the upper backrest frame 9 is fixed with an upper backrest shaft bushing 7 which can rotate relative to the underframe fixed shaft 10. The upper backrest frame 9 is rotatably arranged on the left and right underframes 6 and 11 through the upper backrest shaft bushing 7 cooperating with the underframe fixed shaft 10. The upper backrest frame 9 is provided with at least two sets of symmetrically distributed upper backrests 8, which can be fixed or rotatably arranged on the upper backrest frame 9; the lower backrest frame 5 is fixed with a lower backrest shaft bushing 16 which can rotate relative to the armrest frame fixed shaft 14. The lower backrest frame 5 is rotatably arranged on the left and right armrest frames 1 and 15 through the lower backrest shaft bushing 16 cooperating with the armrest frame fixed shaft 14. The lower backrest frame 5 is provided with at least two sets of symmetrically distributed lower backrests 4. The lower backrest 4 can be fixed or rotatably arranged on the lower backrest frame 5.

In order to facilitate the operation and use, the left and right armrest frames 1 and 15 are correspondingly arranged outside the left and right underframes 6 and 11, and the extension parts 19 and 20 of the left and right armrest frames 1 and 15 are correspondingly fixed with the left and right armrests 2 and 13.

In order to effectively train the arm strength and realize the rowing function, two sides of the left and right underframes 6 and 11 are correspondingly provided with detachable elastic pull ropes.

In order to facilitate the installation, the underframe fixed shaft 10 is correspondingly sheathed on the connecting pipes 21 and 22 of the left and right underframes 6 and 11, and is fixedly connected through fasteners. The armrest frame fixed shaft 14 is correspondingly sheathed on the connecting pipes 21 and 22 of the left and right armrest frames 1 and 15, and is fixedly connected through fasteners.

Figure 4:
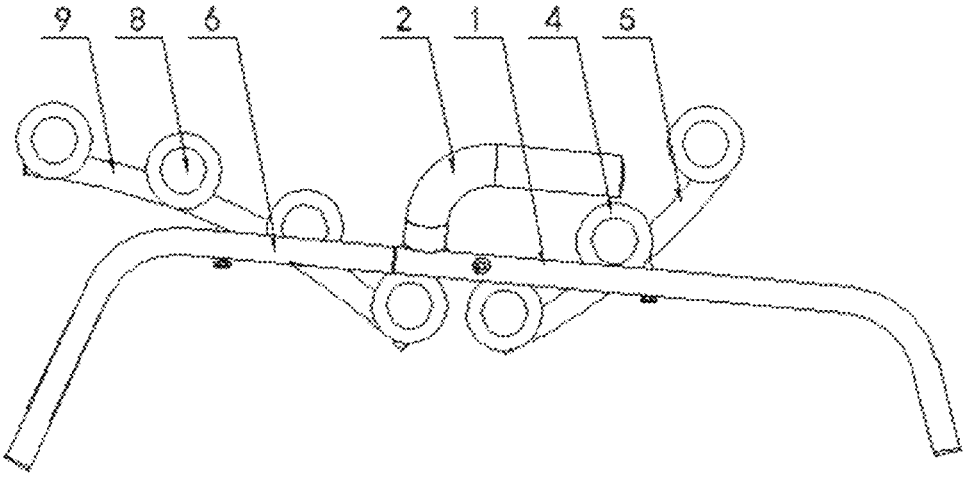
FIG. 4 is a schematic diagram of the matching structure of the present invention during the training of the waist lifting and abdomen retraction.
Figure 5:
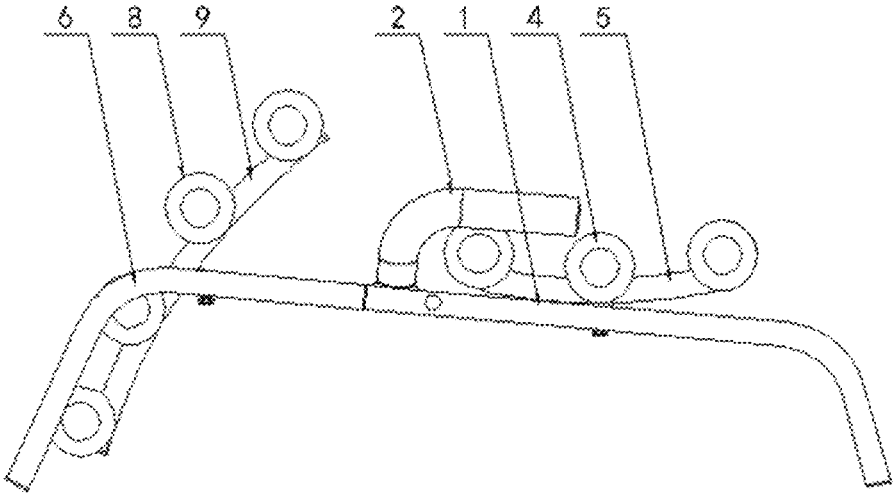
FIG. 5 is a schematic diagram of the matching structure of the present invention when massaging the back.
Figure 6:
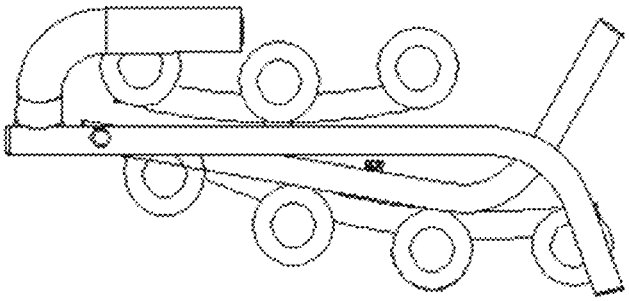
FIG. 6 is a schematic diagram of the structure in the folded state of the present invention.

When the present invention sits on the lower backrest 4 and the back rests on the upper backrest 8, as shown in FIG. 4, if the feet do not fall to the ground, it can do the waist straightening and deep V-shaped abdominal retraction training; if the feet are on the floor, it can do sit-up, waist straightening and abdomen training; if both feet fall to the ground, elastic pull ropes are set on both sides of the left and right underframes 6 and 11 to cooperate, so as to do arm strength training; push up training can also be carried out by using the left and right armrests 2 and 13. When the upper backrest 8 is turned back, as shown in FIG. 5, the feet are on the ground and the back rests on the upper backrest 8, and the hips can be lifted back for abdominal training. The present invention has multiple training functions and good fitness effect.

The above description is only the specific embodiment of the present invention, and does not limit the present invention in any form. On the basis of not departing from the technical solution of the present invention, the simple modifications, equivalent changes or modifications made fall into the protection scope of the present invention.

The invention claimed is:

1. A multifunctional fitness chair, which comprises an underframe, an armrest, an upper back support and a lower backrest frame, wherein the underframe comprises left and right underframes, and underframe fixed shaft fixedly connected between the left and right underframes, and the armrest comprises left and right armrest frames and armrest frame fixed shaft fixedly connected between the left and right armrest frames, the left and right underframes are hinged on the left and right armrest frames through axle pins, and extension parts of the left and right armrest frames respectively include left and right limiting plates which restrict upward rotation of the left and right underframes; the upper backrest frame is coupled to an upper backrest shaft bushing where the upper backrest shaft bushing is rotatable relative to the underframe fixed shaft, the upper backrest frame is rotatable relative to the left and right underframes when the upper backrest shaft bushing rotates on the underframe fixed shaft, and at least two sets of symmetrically distributed upper backrests are arranged on the upper backrest frame; the lower backrest frame is coupled to a lower backrest shaft bushing where the lower backrest shaft bushing is rotatable relative to the armrest frame fixed shaft, the lower backrest frame is rotatable relative to the left and right armrest frames when the lower backrest shaft bushing rotates on the armrest frame fixed shaft, and at least two sets of symmetrically distributed lower backrests are arranged on the lower backrest frame.

2. The multifunctional fitness chair according to claim 1, wherein the left and right armrest frames are respectively arranged outside the left and right underframes, and the extension parts of the left and right armrest frames are respectively coupled with the left and right armrests.

3. The multifunctional fitness chair according to claim 1, wherein the underframe fixed shaft is coupled on the connecting pipes of the left and right underframes and fixedly connected.

4. The multifunctional fitness chair according to claim 3, wherein the armrest frame fixed shaft is coupled on the connecting pipes of the left and right armrest frames and fixedly connected.

* * * * *